United States Patent [19]

Mitsuya et al.

[11] Patent Number: 4,821,052

[45] Date of Patent: Apr. 11, 1989

[54] FLASH FUSING APPARATUS FOR REDUCING OCCURRENCE OF SPOTS ON RECORDING PAPER

[75] Inventors: Teruaki Mitsuya, Hitachi; Takao Kumasaka, Takahagi; Shinichi Nishino; Masato Yamada, both of Katsuta; Shigetaka Fujiwara, Yokohama, all of Japan

[73] Assignees: Hitachi, Ltd.; Hitachi Koki Co., Ltd., both of Tokyo, Japan

[21] Appl. No.: 102,434

[22] Filed: Sep. 29, 1987

[30] Foreign Application Priority Data

Sep. 29, 1986 [JP] Japan ..... 61-228472
Oct. 9, 1986 [JP] Japan ..... 61-239333

[51] Int. Cl.[4] ..... G03G 15/20

[52] U.S. Cl. ..... 355/14 FU; 355/3 FU; 219/216

[58] Field of Search ..... 355/3 FU, 3 R, 14 FU, 355/30; 219/216

[56] References Cited

U.S. PATENT DOCUMENTS 3,445,626 5/1969 Michaels ..... 355/3 FU
4,386,840 6/1983 Garthwaite et al. ..... 355/3 FU
4,434,353 2/1984 Marsh et al. ..... 355/3 FU

FOREIGN PATENT DOCUMENTS 52-20841 2/1977 Japan ..... 355/3 FU
54-126547 10/1979 Japan ..... 355/3 FU
60-128477 7/1985 Japan ..... 355/3 FU
60-237481 11/1985 Japan ..... 355/3 FU
61-200566 9/1986 Japan ..... 355/3 FU
61-200567 9/1986 Japan ..... 355/3 FU

*Primary Examiner*—R. L. Moses
*Attorney, Agent, or Firm*—Antonelli, Terry & Wands

[57] ABSTRACT

A flash lamp apparatus for reducing occurrence of spots on a recording paper wherein an overlapping portion formed between two adjacent fusing areas of the recording paper receives a first flash and a second flash from a flash lamp so as to heat and fuse a toner on the recording paper. The overlapping portion is controlled so as to reduce occurrence of spots on the recording paper by reducing an area of the overlapping portion on a recording paper. Such reduction in the overlapping portion may be obtained by controlling a frequency of the flash or controlling a feeding velocity of the recording paper. Alternatively, the fusing energy of the overlapping portion may be reduced by changing alternately the radiating energy.

19 Claims, 4 Drawing Sheets

FLASH FUSING APPARATUS FOR REDUCING OCCURRENCE OF SPOTS ON RECORDING PAPER

BACKGROUND OF THE INVENTION

1. Field of the Invention

The present invention relates to a flash fusing apparatus and more particularly to a flash fusing apparatus wherein the toner is heated and fused on the recording paper by means of the flash of light. The flash fusing apparatus of the present invention is applied for use in the laser beam printers and the facsimile equipments etc. wherein the image is recorded on the recording paper by the toner.

2. Description of the Prior Art

A conventional flash fusing apparatus is disclosed in, for example Japanese Utility Model No. 3562/1986, and applied for use in the laser beam printers and the facsimile equipment etc.. In such a flash fusing apparatus, the toner is attached on the recording paper by the electrostatic energy for development process, and in a fusing process the toner is heated and fused on the recording paper by flash of the xenon flash lamp etc. so as to form the image on the recording paper by the toner.

In this flash fusing apparatus, it is desirable to obtain the sharp image on the recording paper without dirty marks or spots appearing on the paper. The spots or smudges occur on the recording paper through the gas generated from the toner when the toner is heated under high temperature condition for the fusing process.

The conventional flash fusing apparatus having a gas suction mechanism is shown in FIG. 12. Toners 84 are arranged on the upper surface of a recording paper 82. The toners 84 are heated and melted with flash of by a xenon flash lamp 81 and thus fused on the recording paper 82. The xenon flash lamp 81 is disposed in a lamp housing 86. The lamp housing 86 has a glass plate member 85 at the bottom portion thereof. The glass plate member 85 is positioned oppositely to the upper surface of the recording paper 82.

Epoxy based toner or polystyrene base toner 84 is used commonly as the toner 84 for the flash fusing apparatus. When the fusing process is carried out, gas generates from the toner 84 according to the abrupt temperature rise of the toner 84 by heating. The generated gas attaches on the upper surface of the recording paper 82 and spots appear also on the upper surface of the recording paper 82. Further, the generated gas attaches also to the surrounding members of the lamp housing 86 such as the glass plate member 85, so that the quantity of light flash of the xenon flash lamp 81 is reduced.

As one of the spots countermeasures in the conventional flash fusing apparatus, a suction hole member 83 as the suction mechanism is provided at the lower portion of one end of the glass plate member 85 as shown in FIG. 12. The generated gas from the toner 84 is suctioned and removed by the suction hole member 83.

However, even when the above mentioned spot countermeasures for the flash fusing apparatus having gas suction mechanism is carried out, it is impossible to get rid of the defects caused by gas generation phenomenon. The spots on the recording paper 82 remain unchanged. Moreover, it is necessary to practise at periodic intervals the cleaning of the glass plate member 85 of the xenon flash lamp 81.

In order to prevent the generation of gas from the toner during the fusing process, flash intensity or the fusing energy. According to the adoption for lowering of the flash intensity, the occurrence of spots may be reduced, however, the adhesion force of the toner with the recording paper is weakened, namely the toner is detached easily from the recording paper.

SUMMARY OF THE INVENTION

An object of the present invention is to provide a flash fusing apparatus wherein the amount of generation of gas can be reduced.

Another object of the present invention is to provide a flash fusing apparatus wherein the occurrence of spots on the recording paper or on the flash lamp surrounding members can be reduced or restrained.

A further object of the present invention is to provide a flash fusing apparatus wherein the overlapping portion formed adjacent two fusing areas can be reduced.

A still further object of the present invention is to provide a flash fusing apparatus wherein the fusing energy at the overlapping portion can be reduced.

A term "gas" in the present invention is defined that it is not always entirely in the gas phase condition but it indicates all substances discharged in the atmosphere by heating the toner. The gas in the present invention exhibits mainly in the gas phase condition, however when the minute particles exist in the gas, the gas including the minute particles is considered to be gas in the present invention.

The inventors of the present invention obtained the experimental observation results that the spots occur on the recording paper at regular intervals simultaneously with the flash periodic times owing to the generation of gas.

In case of the flash fusing process, the predetermined fusing area on the recording paper is fused all at once by one flash. It must not cause fusing in the non-fusing area between one fusing area or a first fusing area $a_1$ and the succeeding fusing area at the recording paper sending direction or a second fusing area $a_2$. It is ordinary to set the flash frequency or the feeding velocity of the recording paper so as to have an overlapping portion $b_1$ between the first fusing area $a_1$ and the second fusing area $a_2$ as shown in FIG. 6.

From the above-mentioned experimental observation results, the spots occur at the overlapping portion $b_1$ between the first fusing area $a_1$ and the second fusing area $a_2$. The overlapping portion $b_1$ includes the lateral overlapping width $b_0$ having about 2–4 mm. The reason of occurrence for the spot is that the flash radiates two times at the overlapping portion $b_1$. The overlapping portion $b_1$ is also two times radiation area. The following properties became clear after studying the experimental observation results, namely, the fusing energy became excessive only at the overlapping portion $b_1$, then the gas generates abnormally from the overlapping portion $b_1$ on the recording paper.

Therefore, it is possible to restrain the abnormal generation of gas through the disappearance of the fusing energy excessive portion $b_1$ according to the reduction of the overlapping portion $b_1$. However, when the overlapping portion $b_1$ is reduced, the fusing intensity at the overlapping portion $b_1$ may be reduced. As a result, it lowers the reliability when the overlapping portion $b_1$ is reduced at all times.

The abnormal generation of gas from the toner and the attachment phenomenon of the generated gas on the recording paper, which cause the spots depend on the temperature in the flash fusing apparatus main body or the air current stability generated by the air suction etc., and they do not necessarily generate or occur at all times. Therefore, the above-mentioned objects of the present invention are attained through the reduction of the overlapping portion $b_1$, when the spots appear or the sign of the spot occurrence is detected or known in advance.

When the flash frequency of the flash is represented by f, the recording paper sending velocity is represented by L, the fusing area is represented by $a_0$, and the lateral overlapping width of the overlapping portion $b_1$ is represented by $b_0$, the formula that expresses the relationship between the flash frequency of the flash f, the recording paper sending velocity L, the fusing area $a_0$, and the lateral overlapping width $b_0$ can be expressed as follows.

$$b_0 = a_0 - L/f \quad (1)$$

As understood from the above formula (1), when the flash frequency f is made smaller or when the recording paper feeding velocity L is made larger, it functions os as to make the lateral overlapping width $b_0$ smaller. Thereby, the fusing energy excessive portion $b_1$ produced by two times radiation operations is made smaller, accordingly the abnormal generation of gas, which causes occurrence of the spots can be eliminated.

In the present invention, a flash fusing apparatus comprises a recording paper, means for feeding the recording paper, a lamp receiving means disposed oppositely to the recording paper and including a flash lamp and glass plate, a toner member being developed on the recording paper, and means for heating the toner by the flash light and for fusing the toner member on the recording paper, wherein an overlapping portion formed between two adjacent two fusing areas of the recording paper receives a first flash and a second flash from the heating and fusing means.

Means for controlling the overlapping portion is provided so as to reduce an area of the overlapping portion on said recording paper. The overlapping portion controlling means is means for controlling the flash frequency from the heating and fusing means or means for controlling the feeding velocity of the recording paper.

When spots occur on the lamp receiving means and/or the recording paper by gas generated from the toner on the recording paper, means for changing alternately radiating energy of the heating and fusing means is provided so as to reduce the fusing energy of the overlapping portion.

A gas concentration detector is provided so as to detect gas generated from the toner member on the recording paper, means for changing alternately radiating energy of the heating and fusing means is provided so as to reduce fusing energy of the overlapping portion, and the radiating energy change means is changed alternately by a detected value of the gas concentration detector.

According to the present invention, the amount of generation of gas can be reduced since the gas, which is generated from the toner at the overlapping portion $b_1$ formed adjacent two fusing areas $a_1$ and $a_2$, is restrained. The occurrence of the spots on the recording paper and on the flash lamp surrounding members such as the glass plate member can be restrained.

DESCRIPTION OF THE INVENTION

Figure 1:
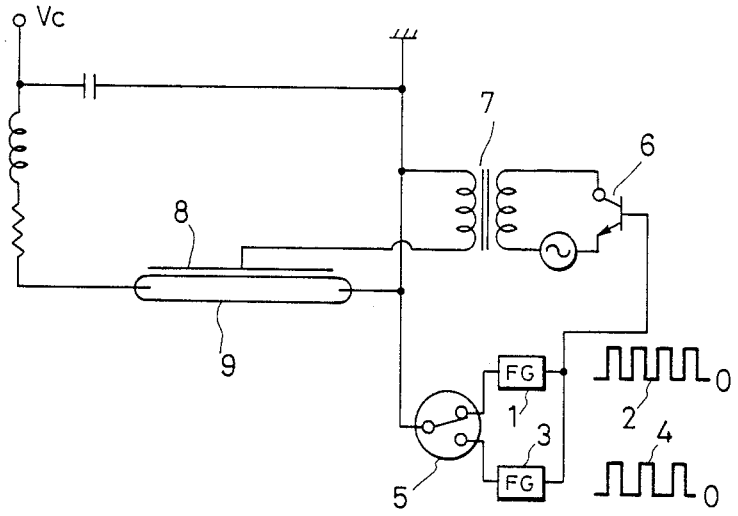
FIG. 1 is a flash electric circuit showing the flash fusing apparatus according to one embodiment of the present invention.

Several embodiments of the present invention will be explained by referring to the drawings. In the following embodiments of the present invention, the overlapping portion is reduced, when the spots appear or the sign of the spot occurrence is detected or known in advance.

EMBODIMENT 1

FIG. 1 is a photoflash electric circuit for the flash fusing apparatus according to one embodiment of the present invention. A function generator (FG) 1 outputs a square waveform 2 having a TTL level. A function generator (FG) 3 output a square waveform 4 having a TTL level. A change-over switch 5 selects one of the square waveform 2 of the function generator 1 and the square waveform 4 of the function generator 3 and applies the selected square waveforms 2 or 4 to a transistor 6. A high frequency current increased by a coil 7 is supplied to a trigger wire 8 according to the square waveform 2 or 4 of the function generator 1 or 3. A xenon flash lamp 9 flashes periodically according to the periodic time of the square waveform 2 or 4.

The frequency for the square waveform 2 of the function generator 1 is set to be higher than that of the square waveform 4 of the function generator 3. When the side of the function generator 3 is selected by the change-over switch 5, the flash periodic time of the xenon flash lamp 9 is made shorter. For example, the flash frequency of the function generator 1 and 3 is set to be 2.2 $H_z$ and 2.0 $H_z$, respectively. When the side of the function generator 3 is selected by the change-over switch 5, the flash periodic time of the xenon flash lamp 9 is made longer. The change-over switch 5 is closed commonly at the side of the function generator 1, in order to make the periodic time shorter so as to not lower the fusing intensity at the overlapping portion $b_1$.

Figure 2:
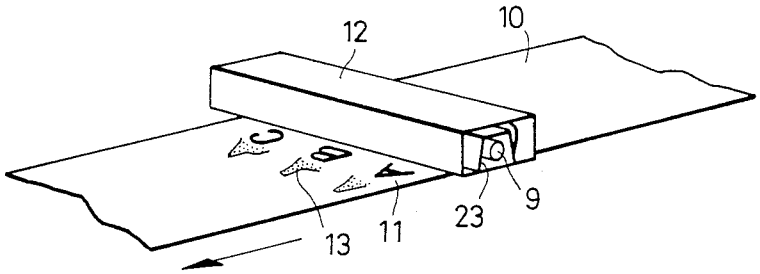
FIG. 2 is a perspective view of the flash fusing apparatus showing relationship between the flash lamp and the recording paper having spots thereon.

FIG. 2 is a perspective view showing the lamp housing and the recording paper according to the flash fusing apparatus of the present invention. The xenon flash lamp 9 is provided within a lamp housing 12. The lamp housing 12 has a glass plate member 23 disposed oppositely to a recording paper 10. The recording paper 10 is a continuous paper having 15 inch×11 inch size. Toners on the recording paper 10 are subjected to the light flash radiation during the passing process of the lamp housing 12 and then fused on the recording paper 10. The feeding velocity L of the recording paper 10 is set to be 8.44 cm/s. An image 11 is recorded on the recording paper 10 by the toners. In normal operating condition, the change-over switch 5 is closed at the side of the function generator 1. The part of the toners is positioned at the overlapping portion $b_1$, which is formed adjacent two fusing areas on the recording paper 10. In this case the spots 13 occur in front of the overlapping portion $b_1$ having the lateral overlapping portion width $b_0$ of about 2–4 mm on the recording paper 10.

When an operator, who operates the laser beam printer having the flash fusing apparatus to his embodiment of the present invention, discover the spots, then the operator changes over from the function generator 1 to the side of the function generator 3 by the change-over switch 5. Then the flash periodic time is made longer by change-over toward the function generator 3 and the area of the overlapping portion $b_1$ or the lateral overlapping width $b_0$ is made smaller about 1 mm. Therefore, the abnormal generation of gas disappears and, no spots 13 occur in future.

However, when the operator leaves the laser beam printer in this operating condition as it is, it gives rise to the problem that the fusing intensity becomes lowered at the overlapping portion $b_1$. When the printing using the function generator 3 carries out at some extent, it is necessary to return the contact point of the changeover switch 5 toward the side of the function generator 1. The spots 13 occur continuously over about ten pages of the recording paper 10 at the most, so that the change-over switch 5 may be returned toward the side of the function generator 1 after the completion of printing using the function generator 3 over about twenty pages of the recording paper 10.

According to the above embodiment of the present invention, the area of the overlapping portion $b_1$ or the lateral overlapping width $b_0$ is made smaller about 1 mm. Therefore, the abnormal generation of gas disappears and, no spots 13 occur in future. Further the occurrence of spots 13 continuously commonly over about ten pages is restrained, as a result the appearance of spots 13 is reduced within about four or five lines in the recording paper 10 and may be minimized one line in the recording paper 10.

It is noted with respect to the restraint of the spots 13 on the recording paper 10, in addition to the above matter, the spots 13 of surrounding members 23 of the xenon flash lamp 9 can be restrained because the amount of the gas generation is reduced.

EMBODIMENT 2

Figure 3:
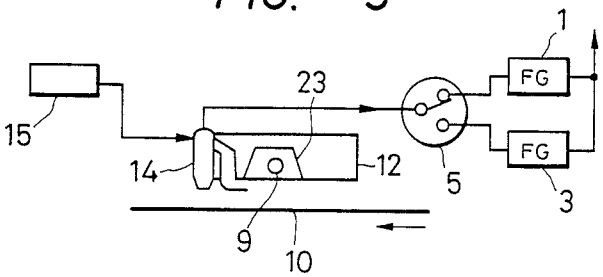
FIG. 3 is a schematic side view showing the flash fusing apparatus according to another embodiment of the present invention.

FIG. 3 is a cross-sectional side view showing the flash fusing apparatus according to another embodiment of the present invention. An image coverage detector 14 is provided at the down stream of the recording paper feeding direction of the lamp housing 12. A judgment device 15 for judging the non-printing portion is connected to the image coverage detector 14 and judges the non-printing portion of the recording paper 10 from the image memory.

When, in the non-printing portion judged from the judgment device 15, the image coverage detector 14 detects the coverage value more than a predetermined coverage value of the white portion of the recording paper 10, it is determined that the spots 13 occur on the recording paper 10. Then the change-over switch 5 is changed over automatically toward the side of the function generator 3 from the function generator 1, and after the printing using the function generator 3 is practised over about twenty pages of the recording paper 10, the change-over switch 5 is changed over automatically so as to return the side of the function generator 1. Thereby, the occurrence of the spots 13 can be restrained automatically.

According to this embodiment of the present invention, the spots 13 can be restrained automatically without observation by the operator.

EMBODIMENT 3

Figure 4:
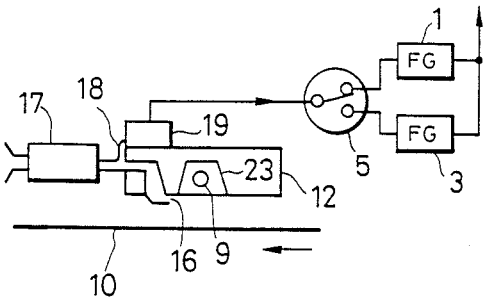
FIG. 4 is a schematic side view showing the flash fusing apparatus according to a further embodiment of the present invention.

FIG. 4 is a cross-sectional side view showing the flash fusing apparatus according to a further embodiment of the present invention. A suction hole member 16 is provided at the down stream position of the recording paper feeding direction from the xenon flash lamp 9 so as to absorb the generated gas.

The generated gas is absorbed by a purification unit 17. The purification unit 17 comprises a suction blower and a gas purification device. An air bypass passage 18 is formed to communicate between the suction hole member 16 and the purification unit 17. A part of the suction air is led into a gas concentration detector 19 through the air bypass passage 18.

When the gas concentration in the flash fusing apparatus reaches to a predetermined value, the gas concentration detector 19 changes over automatically the change-over switch 5 toward the side of the function generator 3 from the function generator 1. After the printing using the function generator 3 is practised over about twenty pages of the recording paper 10, the gas concentration detector 19 changes over automatically the change-over switch 5 so as to return the side of the function generator 1.

The gas concentration in the flash fusing apparatus rises abruptly before the spot occurrence. When the gas concentration reaches over the predetermined value, then the spots 13 occur. Accordingly, a value for changing over the change-over switch 5 is set to be lower than that of the gas concentration in which the spots 13 occur and to be higher than that of the ordinary gas concentration in which no spots 13 occur. Therefore, the occurrence of the spots 13 can be eliminated.

According to this embodiment of the present invention, it is unnecessary to practise the watching by the operator, and no dirty marks can be occurred.

EMBODIMENT 4

Figure 5:
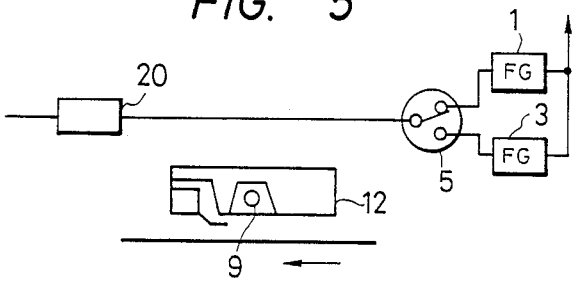
FIG. 5 is a schematic side view showing the flash fusing apparatus according to a still further embodiment of the present invention.
Figure 6:
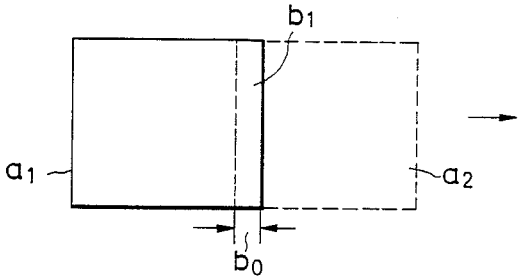
FIG. 6 is an explanatory view showing the overlapping portion formed at two adjacent fusing areas.

FIG. 5 is a cross-sectional side view showing the flash fusing apparatus according to a still further embodiment of the present invention. The factors for controlling the occurrence of the spots 13 are the image coverage m, the image density d, the photoflash frequency f, the fusing energy e, the recording paper feeding velocity L, the flash fusing apparatus main body temperature T, and the air stability s.

When the flash fusing apparatus main body temperature T and the air stability s is estimated with minimum quality value toward the spot occurrence, the spot occurrence condition $C_{dm}$ is shown as the following formula, in which if the spot function g were made clear.

$$C_{dm} < g\ (m, d, f, e, L) \quad (2)$$

In this case, the factors of the image density d, the frequency f, the fusing energy e, the recording paper feeding velocity L are predetermined set values respectively, so that the variable for affecting the spot occurrence condition $C_{dm}$ is only the image coverage m. However, the factors of the flash fusing apparatus main body temperature T and the air stability s are estimated with the minimum quality value, even when the condition of the formula (2) is satisfied, it does not necessary follow that the spots 13 occur.

In FIG. 5, an image coverage detector 20 is connected to the change-over switch 5. The image coverage data from the image memory is supplied into the image coverage detector 20. The image coverage detector 20 detects the image coverage m in the recording paper 10. Only when the spot occurrent condition C is satisfied with the formula (2) by the detection through the image coverage detector 20, the change-over switch 5 is closed automatically toward the side of the function generator 3 from the function generator 1 before the timing for occurring the spots 13 take place.

According to this embodiment of the present invention, the occurrence of the spots 13 can be eliminated and simultaneously the spots 13 of the surrounding members 23 of the xenon flash lamp 9 can be restrained without the installation of additional attachment apparatus and without observation by the operator.

EMBODIMENT 5

The objects of the present invention can be attained by the increase of the recording paper feeding velocity L. Namely, when the flash frequency f remains unchanged to be set 2.2 $H_z$ as same as the prior art, the recording paper feeding velocity L is increased from 8.44 cm/s to 9.28 cm/s.

In this embodiment, the overlapping portion b is made smaller according to increase of the recording paper feeding velocity L.

According to this embodiment of the present invention, the amount of generation of gas can be reduced since the gas generated from the overlapping portion $b_1$ is restrained. The occurrence of the dirty marks 13 on the recording paper 10 and the lamp surrounding members 23 can be restrained.

Next, other embodiments of the present invention will be explained referring to the drawings. In the following embodiments of the present invention, the radiating energy of the first fusing area ($a_1$) and the second fusing area ($a_2$) are lowered uniformly or the radiating energy of only the second fusing area ($a_2$) is reduced, when the occurrence of the spot is detected or the sign of the spot occurrence is detected or known in advance.

EMBODIMENT 6

Figure 7:
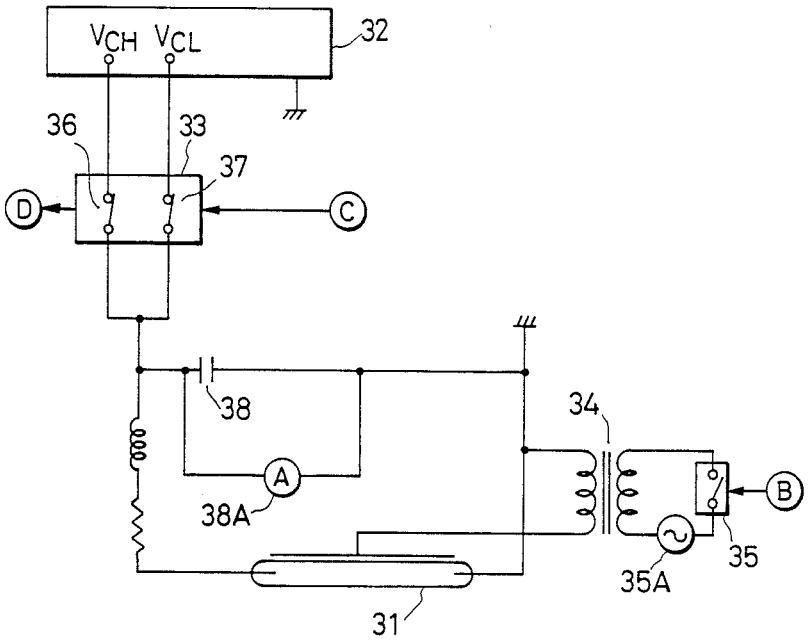
FIG. 7 is a photoflash electric circuit and terminal signals showing the flash fusing apparatus according to one embodiment of the present invention.
Figure 8:
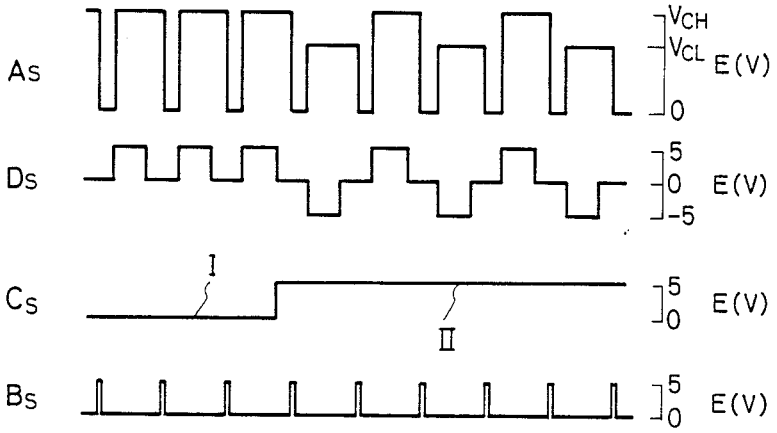
FIG. 8 shows the waveforms of the terminal signals shown in FIG. 7.

FIG. 7 flash electric circuit and terminal signal view showing the flash fusing apparatus according to one embodiment of the present invention. FIG. 8 shows a motion waveforms view of the various terminal signals.

The flash fusing apparatus comprises a xenon flash lamp 31, a power source 32, a switch unit 33 for controlling the radiating energy, a flash trigger circuit 34, a switch unit 35 for controlling the flash periodic time, an internal switch 36, an internal switch 37 and a condenser 38.

The flash lamp 31 comprises a xenon flash lamp etc.. The xenon flash lamp 31 is triggered to provide the flash. Toners arranged on the recording paper are fused on the recording paper owing to heat caused during flash process.

The power source 32 generates two different DC voltages $V_{CH}$ and $V_{CL}$. Voltage $V_{CH}$ is higher than the voltage $V_{CL}$. For example, the condenser 38 is 200 $\mu$F, the voltage $V_{CH}$ is 2000 V, and the voltage $V_{CL}$ is 1900 V.

The switch unit 33 is used for controlling the radiating energy. The switch unit 33 has two internal switches 36 and 37. The switch unit 33 operates according to the voltage magnitude of a control signal $C_s$.

(i) When the voltage of the control signal $C_s$ is 0 (V),
the internal switch 37 . . . OFF
the internal switch 36 . . . ON
(control signal $B_s$. . 5 (V))
the internal switch 36 . . . OFF
(control signal $B_s$. . O(V))

(ii) When the voltage of the control signal $C_s$ is 5 (V), the internal switch 36 and the internal switch 37 opens or closes periodically by the control signal $B_s$.

(iii) The output voltage of the switch unit 33 is +5 (V), (when the internal switch 36 is ON), −5 (V) (when the internal switch 37 is ON), and 0 (V) (when both of the internal switch 36 and
the internal switch 37 are OFF).

The switch unit 35 is used for controlling the flash periodic time. The switch unit 35 repeats ON and OFF by the control signal $B_s$. For example, when the voltage of the control signal $B_s$ is +5 (V), the switch unit 35 becomes ON condition, and when the voltage of the control signal $B_s$ is 0 (V), the switch unit 35 becomes OFF condition.

The transformer 34 and an AC power source 35A produce DC output when the switch unit 35 is ON condition. The secondary side of the transformer 34 becomes DC input of the xenon flash lamp 31.

The condenser 38 charges the output of the switch unit 33 and in next periodic time discharges the charge value stored in the condenser 38. The discharge is practised during ON condition of the switch unit 35. The xenon flash lamp 31 flashes by above discharge action.

When the voltage of the control signal $C_s$ during the interval I is 0 (V), the radiating energy of the xenon flash lamp 31 becomes to be high in whole photoflash actions. (see FIG. 8). When the voltage of the control signal $C_s$ during the interval II is 5 (V), the radiating energy is changed alternately and the xenon flash lamp 31 flashes with the different radiating energy. For example, the radiating energy having 2.2 J/cm$^2$ is changed to the radiating energy having 2.0 J/cm$^2$. The radiating energy becomes lower every other flash. In the interval II of the control signal $C_s$, the fusing energy at the overlapping portion is reduced every other flash.

A checking meter 38A checks both ends voltage of the condenser 38 and produces a signal $A_s$. The terminal D is used for checking the output voltage of the switch unit 33 and produces a signal $D_s$. The variation of the radiating energy is checked by the checking meter 38A and the terminal D.

The operation of the flash fusing apparatus of the above embodiment of the present invention will be explained as follow.

During the normal operation, the voltage of the control signal $C_s$ is maintained at 0 (V). The xenon flash lamp 31 is given voltage $V_{CH}$ at periodic time of the control signal $B_s$ form the condenser 38 through the internal switch 36. The xenon flash lamp flashes with the recording paper and the toner is fused on the recording paper.

When spots occur on the recording paper, the voltage of the control signal $C_s$ is made 5 (V). Thereby, the internal switch 36 and the internal switch 37 becomes alternately ON condition by the control signal $B_s$. The xenon flash lamp 31 is applied alternately the high level voltage (for example, voltage $V_{CH}$ 2000 V) or the low level voltage (for example, voltage $V_{CL}$ 1900 V). By this voltage application, the radiating energy becomes a low value every one periodic time when the spots occur. Therefore, the radiating energy with the overlapping portion is lowered, the occurrence of new spots is restrained.

It is possible to generate the control signal $C_s$ by manual operation or automatic operation. In the manual operation, the operator can confirm the occurrence of the spots by watching. If the dirty marks are confirmed, the operator marks control signal $C_s$ to +5 (V). In the automatic operation, the occurrence of the spots and the generation of gas are detected automatically, and further the control signal $C_s$ is changed over automatically to +5 (V).

In the laser beam printer having the flash fusing apparatus according to the embodiment of the present invention, when the operator discovers the spots, the operator makes the control signal $C_s$ to apply 5 (V) using the function generator etc.. The fusing energy at the overlapping portion is reduced because the radiating energy is reduced alternately. Accordingly, the abnormal generation of gas from the overlapping portion can be eliminated and no spots occur in future.

However, when the operator leaves the laser beam printer in this condition, it gives rise to the problem that the fusing intensity becomes lowered at the overlapping portion. When the printing using the voltage of the control signal $C_s$ at 5 (V) carries out at some extent, it is necessary to return the voltage of the control signal $C_s$ at voltage 0 (V). The spots occur continuously over about ten pages of the recording paper at the most, so that the voltage of the control signal $C_s$ may be made to return at voltage 0 (V) after the completion of printing using the voltage of the control signal $C_s$ at 5 (V) over about twenty pages of the recording paper.

According to the above embodiment of the present invention, the occurrence of spots continuously commonly over about ten pages of the recording paper is restrained, as a result the dirty marks are reduced within about four or five lines in the recording paper and may be minimized one line in the recording paper.

EMBODIMENT 7

Figure 9:
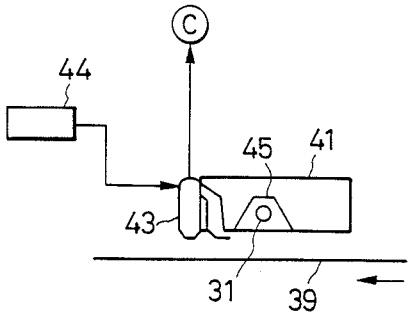
FIG. 9 is a schematic side view showing the flash fusing apparatus according to another embodiment of the present invention.

FIG. 9 is a cross-sectional side view showing the flash fusing apparatus according to another embodiment of the present invention. An image coverage detector 43 is provided at the down stream of the recording paper sending direction of a lamp housing 41 having a glass plate member 45. A judgment device 44 for judging the non-printing portion is connected to the image coverage detector 43 and judges the non-printing portion from the image memory.

When, in the non-printing portion judged from the judgment device 44, the image coverage detector 43 detects the coverage value more than a predetermined coverage value of the white portion of a recording paper 39, the spot occur on the recording paper 39 it is determined that. Then the image coverage detector 43 outputs automatically voltage 5 (V), and after the printing with the output 5 (V) is practised over about twenty pages of the recording paper 39, the image coverage detector 43 is changed over automatically so as to return at voltage 0 (V). The above voltages applies respectively to the terminal C. Thereby, after the occurrence of the spots and from the completion of printing with the output 5 (V) of about twenty pages, the occurrence of the spots can be restrained automatically because the radiating energy from a xenon flash lamp 31 is lowered alternately.

According to this embodiment of the present invention, the spots can be restrained automatically without observation by the operator.

EMBODIMENT 8

Figure 10:
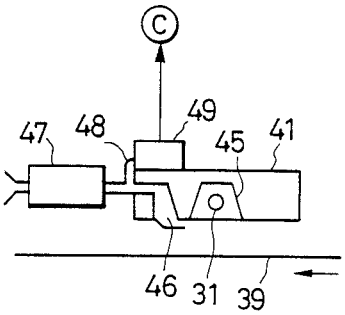
FIG. 10 is a schematic side view showing the flash fusing apparatus according to a further embodiment of the present invention.
Figure 12:
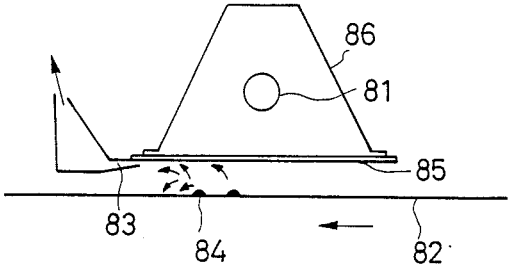
FIG. 12 PRIOR ART
FIG. 12 is a cross-sectional side view showing the conventional flash fusing apparatus.

FIG. 10 is a cross-sectional side view showing the flash fusing apparatus according to a further embodiment of the present invention. A suction hole member 46 is provided at the down stream position of the recording paper feeding direction from the xenon flash lamp 31 so as to absorb the generated gas.

The generated gas is absorbed by a purification unit 47. The purification unit 47 comprises a suction blower and a gas purification device. An air bypass passage 48 is formed to communicate between the suction hole member 46 and the purification unit 47. A part of the suction air is led into a gas concentration detector 49 through the air bypass passage 48.

When the gas concentration in the flash fusing apparatus reaches to a predetermined value, the gas concentration detector 49 outputs automatically voltage 5 (V). After the printing with output 5 (V) is practised over about twenty pages of the recording paper 39, the gas concentration detector 49 changes over automatically so as to return at voltage 0 (V). The above voltages are applied to the terminal C.

The gas concentration in the flash fusing apparatus rises abruptly before the spot occurrence. When the gas concentration in the flash fusing apparatus reaches over the predetermined value, then the spots occur. Accordingly, a threshold value of the gas concentration detector 49 is set to be at 5 (V) output. The threshold value is lower than that of the gas concentration in which the spots occur and to be higher than that of the ordinary gas concentration in which no spots occur. Therefore, the occurrence of the spots can be eliminated.

According to this embodiment of the present invention, it is unnecessary to have observation by the operator, and no spots occur.

EMBODIMENT 9

Figure 11:
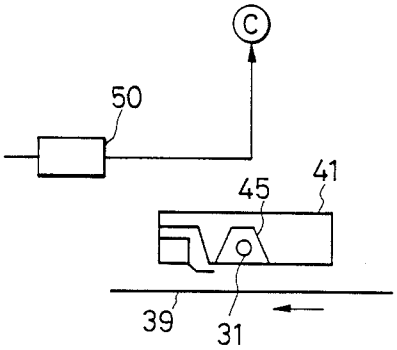
FIG. 11 is a schematic side view showing the flash fusing apparatus according to a still further embodiment of the present invention.

FIG. 11 is a cross-sectional side view showing the flash fusing apparatus according to a still further embodiment of the present invention.

In FIG. 11, the image coverage data from an image memory is supplied into an image coverage detector 50. The image coverage detector 50 detects the image coverage m in the recording paper 39. Only when the spot occurrence condition $C_{dm}$ is satisfied with the formula (2) by the detection through the image coverage detector 50, the image coverage detector outputs automatically the voltage 5 (V) before the timing for occurrence of the spots take place. The output is applied to the terminal C.

According to this embodiment of the present invention, the spot occurrence can be eliminated and simultaneously the spots of the surrounding members of the xenon flash lamp 31 can be restrained without the installation of additional attachment apparatus and without observation by the operator.

We claim:

1. A flash fusing apparatus comprising a recording paper, means for feeding said recording paper, a lamp receiving means disposed oppositely to said recording paper and including a flash lamp and a glass plate member, toner being developed on said recording paper, and means for heating said toner by a flash and for fusing said toner on said recording paper, wherein an overlapping portion formed between two adjacent fusing areas of said recording paper receives a first flash and a second flash from said heating and fusing means, characterized in that means for controlling said overlapping portion is provided so as to reduce an occurrence of spots on said recording paper by reducing an area of said overlapping portion on said recording paper.

2. A flash fusing apparatus according to claim 1, characterized in that said overlapping portion controlling means is means for controlling a frequency of the flash from said heating and fusing means.

3. A flash fusing apparatus according to claim 1, characterized in that said overlapping portion controlling means is means for controlling feeding velocity of said recording paper.

4. A flash fusing apparatus according to claim 1, characterized in that said overlapping portion controlling means is responsive to detection of a spot on said recording paper for reducing a frequency of the flash from said heating and fusing means.

5. A flash fusing apparatus according to claim 1, characterized in that said overlapping portion controlling means is responsive to detection of a spot on said recording paper for increasing a recording paper feeding velocity.

6. A flash fusing apparatus comprising a recording paper, means for feeding said recording paper, a lamp receiving means disposed oppositely to said recording paper and including a flash lamp and a glass plate member, a toner member being developed on said recording paper, and means for heating said toner by a flash and for fusing said toner on said recording paper, wherein an overlapping portion formed between two adjacent fusing areas of said recording paper receives a first flash and a second flash from said heating and fusing means, characterized in that means for controlling said overlapping portion is provided so as to reduce an area of said overlapping portion on said recording paper, said overlapping portion controlling means is means for controlling a frequency of the flash from said heating and fusing means, said frequency controlling means comprises a first function generator and a second function generator, and a first frequency of said first function generator is set higher than a second frequency of said second function generator, thereby when spots are detected on said recording paper, said first function generator is changed over to said second function generator.

7. A flash fusing apparatus comprising a recording paper, means for feeding said recording paper, a lamp receiving means disposed oppositely to said recording paper and including a flash lamp and a glass plate member, toner being developed on said recording paper, and means for heating said toner by a flash and for fusing said toner on said recording paper, wherein an overlapping portion formed between two adjacent fusing areas of said recording paper receives a first flash and a second flash from said heating and fusing means, characterized in that means for detecting or foreseeing occurrence of a spot on said recording paper is provided, and means for controlling said overlapping portion is provided so as to reduce an area of said overlapping portion on said recording paper, said overlapping portion controlling means is controlled by a signal from said spot detecting or foreseeing means.

8. A flash fusing apparatus according to claim 7, characterized in that said overlapping portion controlling means is means for controlling a frequency of the flash from said heating and fusing means.

9. A flash fusing apparatus according to claim 7, characterized in that said overlapping portion controlling means is means for controlling a feeding velocity of said recording paper.

10. A flash fusing apparatus according to claim 7, characterized in that said spot detecting or foreseeing means is means for detecting spots so as to detect the spot caused by gas, the gas generated from said toner becoming attached to said recording paper.

11. A flash fusing apparatus comprising a recording paper, means for feeding said recording paper, a lamp receiving means disposed oppositely to said recording paper and including a flash lamp and a glass plate member, toner being developed on said recording paper, a suction hole member for suctioning gas and disposed at a down stream of said lamp receiving means, a purification unit for absorbing the gas connected to said suction hole member, an air bypass passage provided to communicate between said suction hole member and said purification unit, and means for heating said toner by a flash and for fusing said toner on said recording paper, wherein an overlapping portion formed between two adjacent fusing areas of said recording paper receives a first flash and a second flash from said heating and fusing means, characterized in that means for detecting or foreseeing occurrence of a spot on said recording paper is provided, and means for controlling said overlapping portion is provided so as to reduce an area of said overlapping portion on said recording paper, said overlapping portion controlling means is controlled by a signal from said spot detecting or foreseeing means.

12. A flash fusing apparatus according to claim 11, characterized in that said spot detecting or foreseeing means is means for detecting a gas condition, the gas being suctioned through said suction hole member.

13. A flash fusing apparatus according to claim 7, characterized in that said spot detecting or foreseeing means is means for detecting image concentration.

14. A flash fusing apparatus comprising a recording paper, means for feeding said recording paper, a lamp receiving means disposed oppositely to said recording paper and including a flash lamp and a glass plate member, toner being developed on said recording paper, and means for heating said toner a flash and for fusing said toner on said recording paper, wherein an overlapping portion formed between two adjacent fusing areas of said recording paper receives a first flash and a second flash from said heating and fusing means, characterized in that means for controlling said overlapping portion is provided so as to reduce an area of said overlapping portion on said recording paper, said overlapping portion controlling means comprises a first function generator and a second function generator, a first frequency of said function generator is set higher than a second frequency of said second function generator, an image coverage detector means is provided at a down stream side of said lamp receiving means, and means for judging a nonprinting portion of said recording paper from an image memory, thereby when said image coverage detector means detects more than a predetermined coverage value, said first function generator is changed over to said second function generator.

15. A flash fusing apparatus comprising a recording paper, means for feeding said recording paper, a lamp receiving means disposed oppositely to said recording paper and including a flash lamp and a glass plate member, toner being developed on said recording paper, a suction hole member for suctioning gas and disposed at a down stream of said lamp receiving means, a purification unit for absorbing the gas connected to said suction hole member an air bypass passage provided to communicate between said suction hole member and said purification unit, and means for heating said toner by a flash and for fusing said toner on said recording paper, wherein an overlapping portion formed between two adjacent fusing areas of said recording paper receives a first flash and a second flash from said heating and fusing means, characterized in that means for controlling said overlapping portion is provided so as to reduce an area of said overlapping portion, said overlapping portion controlling means comprises a first function generator and a second function generator, a first frequency of said function generator is set higher than a second frequency of said second function generator, a gas concentration detector means is provided so as to receive a part of the suctioned gas, thereby when said gas concentration detector means detects more than a predetermined concentration value, said first function generator is changed over to said second function generator.

16. A flash fusing apparatus comprising a recording paper, means for feeding said recording paper, a lamp receiving means disposed oppositely to said recording paper and including a flash lamp and a glass plate member, toner being developed on said recording paper, and means for heating said toner by a flash light and for fusing said toner on said recording paper, wherein an overlapping portion formed between two adjacent fusing areas of said recording paper receives a first flash and a second flash from said heating and fusing means, characterized in that when spots occur on said lamp receiving means and/or said recording paper by gas generated from said toner on said recording paper, means for changing alternately radiating energy of said heating and fusing means is provided so as to reduce the occurrence of the spots and to reduce fusing energy of said overlapping portion.

17. A flash fusing apparatus according to claim 16, characterized in that said means for changing alternately radiating energy of said heating and fusing means is responsive to detection of a spot on said lamp receiving means and/or said recording paper to reduce the occurrence of spots.

18. A flash fusing apparatus comprising a recording paper, means for feeding said recording paper, a lamp receiving means disposed oppositely to said recording paper and including a flash lamp and a glass plate member, toner being developed on said recording paper, and means for heating said toner by a flash light and for fusing said toner on said recording paper, wherein an overlapping portion formed between two adjacent fusing areas of said recording paper receives a first flash and a second flash from said heating and fusing means, characterized in that a gas concentration detector is provided so as to detect gas generated from said toner on said recording paper, means for changing alternately radiating energy of said heating and fusing means is provided so as to reduce fusing energy of said overlapping portion, and said radiating energy change means is changed alternately by a detected value of said gas concentration detector.

19. A flash fusing apparatus according to claim 16 or 18, characterized in that the alternate change of the radiating energy is practised at a predetermined time, and after the radiating energy is returned to have an original radiating energy value.

* * * * *